US009425526B2

(12) United States Patent
Uratani

(10) Patent No.: US 9,425,526 B2
(45) Date of Patent: Aug. 23, 2016

(54) CONNECTOR SET AND CONNECTOR

(71) Applicant: MURATA MANUFACTURING CO., LTD., Kyoto-fu (JP)

(72) Inventor: Chikara Uratani, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/717,377

(22) Filed: May 20, 2015

(65) Prior Publication Data

US 2015/0357735 A1 Dec. 10, 2015

(30) Foreign Application Priority Data

Jun. 5, 2014 (JP) ..... 2014-116841

(51) Int. Cl.
*H01R 12/71* (2011.01)
*H01R 13/6473* (2011.01)

(52) U.S. Cl.
CPC ..... *H01R 12/716* (2013.01); *H01R 13/6473* (2013.01)

(58) Field of Classification Search
CPC ..... H01R 13/648; H01R 13/658; H01R 13/6581; H01R 13/6582; H01R 13/6583; H01R 13/6594; H01R 13/6595
USPC ..... 439/74
See application file for complete search history.

(56) References Cited

U.S. PATENT DOCUMENTS 5,697,799 A * 12/1997 Consoli ..... H01R 23/6873 439/181
5,931,689 A * 8/1999 Patel ..... H01R 13/20 439/346
6,056,560 A * 5/2000 Wu ..... H01R 23/6873 439/108
6,213,810 B1 * 4/2001 Okano ..... H01R 12/592 439/495

FOREIGN PATENT DOCUMENTS

JP 3112259U 8/2005
JP 2006-059589A 3/2006

(Continued)

OTHER PUBLICATIONS

An Office Action; Notice of Reasons for Rejection, issued by the Japanese Patent Office on Mar. 29, 2016, which aorresponds to Japanese Patent Application No. 2014-116841 and is related to U.S. Appl. No. 14/717,377; with English Language Translation.

*Primary Examiner* — Ross Gushi
(74) *Attorney, Agent, or Firm* — Studebaker & Brackett PC

(57) ABSTRACT

An outer peripheral surface of a first anchoring terminal has a first surface facing one side of a second direction and a second surface facing one side of a third direction in a first corner portion, and a third surface facing the other side of the second direction and a fourth surface facing the other side of the third direction in a second corner portion. An inner peripheral surface of a second anchoring terminal has a fifth surface facing the other side of the second direction and a sixth surface facing the other side of the third direction in the first corner portion, and a seventh surface facing the one side of the second direction and an eighth surface facing the one side of the third direction in the second corner portion. The first to fourth surfaces make contact with the fifth to eighth surfaces, respectively.

13 Claims, 19 Drawing Sheets

(56) References Cited

U.S. PATENT DOCUMENTS 6,478,623 B1 * 11/2002 Wu ..... H01R 13/65802 439/607.35
6,485,328 B1 * 11/2002 Wu ..... H01R 23/6873 439/567
6,500,013 B1 * 12/2002 Wang ..... H01R 12/598 439/108
6,641,435 B1 * 11/2003 Ko ..... H01R 9/0527 439/108
6,655,992 B1 * 12/2003 Ko ..... H01R 12/775 439/497
6,767,251 B2 * 7/2004 Yu ..... H01R 23/6873 439/607.37
6,846,187 B2 * 1/2005 Yu ..... H01R 13/20 439/346
6,923,659 B2 * 8/2005 Zhang ..... H01R 12/716 439/74
7,052,286 B2 * 5/2006 Zhang ..... H01R 23/6873 439/108
7,070,423 B2 * 7/2006 Zhang ..... H01R 12/716 439/74
7,074,085 B2 * 7/2006 Chen ..... H01R 23/6873 439/108
7,168,986 B1 * 1/2007 Peng ..... H01R 23/6873 439/607.04
7,431,617 B2 * 10/2008 Yamaji ..... H01R 13/65802 439/607.17
7,585,185 B2 * 9/2009 Obikane ..... H01R 13/65802 439/108
7,717,719 B2 * 5/2010 Miyazaki ..... H01R 12/57 439/74
7,758,352 B2 * 7/2010 Zeng ..... H01R 13/26 439/346
7,815,467 B2 * 10/2010 Tsuchida ..... H01R 12/716 439/579
7,845,958 B2 * 12/2010 Hoshino ..... H01R 12/716 439/660
7,967,639 B1 * 6/2011 Huang ..... H01R 13/6594 439/607.35
8,083,527 B2 * 12/2011 Takeuchi ..... H01R 13/26 439/65
8,105,112 B2 * 1/2012 Midorikawa ..... H01R 12/716 439/607.35
8,408,931 B2 * 4/2013 Sato ..... H01R 12/7052 439/357
8,827,724 B2 * 9/2014 Takeuchi ..... H01R 12/716 439/74
8,840,407 B2 * 9/2014 Nose ..... H01R 12/716 439/607.35
8,888,508 B2 * 11/2014 Chen ..... H01R 12/712 439/74
8,961,215 B2 * 2/2015 Hasegawa ..... H01R 9/091 439/346
8,979,551 B2 * 3/2015 Mongold ..... H01R 12/73 439/74
8,986,027 B2 * 3/2015 Nishimura ..... H01R 12/707 439/181
8,992,233 B2 * 3/2015 Miyazaki ..... H01R 12/707 439/74
8,992,234 B2 * 3/2015 Yoshioka ..... H01R 12/716 439/74
9,039,428 B2 * 5/2015 Sasaki ..... H01R 12/716 439/74
9,048,554 B2 * 6/2015 Tagawa ..... H01R 12/707
9,065,221 B2 * 6/2015 Kimura ..... H01R 12/71
9,190,752 B1 * 11/2015 Little ..... H01R 12/716
9,231,322 B2 * 1/2016 Ozeki ..... H01R 12/73
9,246,279 B2 * 1/2016 Kato ..... H01R 13/6596
2001/0014548 A1 * 8/2001 Matsukawa ..... H01R 12/57 439/74
2005/0026466 A1 * 2/2005 Kubo ..... H01R 13/6275 439/74
2006/0040557 A1 2/2006 Yamaguchi
2006/0040559 A1 2/2006 Zhang et al.
2008/0139057 A1 * 6/2008 Fukuchi ..... H01R 13/658 439/884
2013/0330943 A1 12/2013 Sasaki et al.
2015/0357729 A1 * 12/2015 Uratani ..... H01R 12/716 439/585
2015/0357735 A1 * 12/2015 Uratani ..... H01R 13/6473 439/660

FOREIGN PATENT DOCUMENTS

JP 2012-79684 A 4/2012
JP 2013-089342 A 5/2013

* cited by examiner

CONNECTOR SET AND CONNECTOR

CROSS REFERENCE TO RELATED APPLICATIONS

This application claims benefit of priority to Japanese Patent Application No. 2014-116841 filed Jun. 5, 2014, the entire content of which is incorporated herein by reference.

TECHNICAL FIELD

The present disclosure relates to connector sets and connectors, and particularly relates to connector sets and connectors used to transmit high-frequency signals.

BACKGROUND

A first connector in a board-to-board connector disclosed in Japanese Unexamined Patent Application Publication No. 2012-79684 is known as an example of a past disclosure related to connector sets. The first connector includes a first housing, a plurality of first terminals, and two first reinforcing fittings. The first housing is manufactured from a resin, for example, and is a plate-shaped member having a rectangular shape. The plurality of first terminals are provided along the two longer sides of the first housing. The two first reinforcing fittings are provided at both ends of the first housing in the longer direction thereof.

The stated first connector is used by being coupled to a second connector. The first terminals are connected to a signal potential or a ground potential, and the first reinforcing fittings are connected to the ground potential. Meanwhile, the coupling between the first connector and the second connector is held by the two first reinforcing fittings each engaging with the second connector.

Incidentally, in the first connector disclosed in Japanese Unexamined Patent Application Publication No. 2012-79684, there is a risk that the first terminals will be damaged. To describe this in detail, the first connector engages with the second connector using the two first reinforcing fittings. The two first reinforcing fittings are located at both ends of the first housing in the longer direction thereof. As such, when coupling the first connector and the second connector, positioning in the longer direction of the first housing is achieved by the two first reinforcing fittings making contact with the second connector.

However, in the first connector disclosed in Japanese Unexamined Patent Application Publication No. 2012-79684, the first reinforcing fittings do not contribute to positioning in a shorter direction of the first housing. As such, the positioning in the shorter direction of the first housing is achieved by the first terminals making contact with second terminals in the second connector. Accordingly, during the positioning, the first terminals and the second terminals scrape against each other and the like, which places a large force on the first terminals and the second terminals. There is thus a risk that the first terminals will be damaged.

SUMMARY

Accordingly, it is an object of the present disclosure to provide a connector set and a connector capable of suppressing a connection terminal from being damaged when coupling a first connector and a second connector.

A connector set according to an aspect of the present disclosure is a connector set including a first connector and a second connector. The first connector has a plurality of first connection terminals, each having a first contact portion, and a first anchoring terminal connected to a ground potential. The second connector has a plurality of second connection terminals, each having a second contact portion, and a second anchoring terminal connected to a ground potential. When the first connector and the second connector are coupled, the plurality of first connection terminals and the plurality of second connection terminals respectively make contact at the first contact portions and the second contact portions. The plurality of first contact portions and the plurality of second contact portions are, when viewed from a first direction, enclosed in a rectangular ring having a first corner portion located at one side of a second direction and at one side in a third direction orthogonal to the second direction and a second corner portion located at the other side of the second direction and the other side of the third direction. An outer peripheral surface of the first anchoring terminal has, when viewed from the first direction, a first surface that faces the one side of the second direction and a second surface that faces the one side of the third direction in the first corner portion, and a third surface that faces the other side of the second direction and a fourth surface that faces the other side of the third direction in the second corner portion. An inner peripheral surface of the second anchoring terminal has, when viewed from the first direction, a fifth surface that faces the other side of the second direction and a sixth surface that faces the other side of the third direction in the first corner portion, and a seventh surface that faces the one side of the second direction and an eighth surface that faces the one side of the third direction in the second corner portion. The first surface to the fourth surface make contact with the fifth surface to the eighth surface, respectively, when the first connector and the second connector are coupled.

A first connector according to another aspect of the present disclosure is a first connector that couples with a second connector including a plurality of second connection terminals and a second anchoring terminal. The first connector includes a plurality of first connection terminals and a first anchoring terminal connected to a ground potential. When the first connector and the second connector are coupled, the plurality of first connection terminals make contact with the respective second connection terminals at first contact portions. The first contact portions of the plurality of first connection terminals are, when viewed from a first direction, enclosed in a rectangular ring having a first corner portion located at one side of a second direction and at one side in a third direction orthogonal to the second direction and a second corner portion located at the other side of the second direction and the other side of the third direction. An outer peripheral surface of the first anchoring terminal has, when viewed from the first direction, a first surface that faces the one side of the second direction and a second surface that faces the one side of the third direction in the first corner portion, and a third surface that faces the other side of the second direction and a fourth surface that faces the other side of the third direction in the second corner portion. The first surface to the fourth surface make contact with the second anchoring terminal when the first connector and the second connector are coupled.

According to the present disclosure, a connection terminal can be suppressed from being damaged when the first connector and the second connector are coupled.

Other features, elements, characteristics and advantages of the present disclosure will become more apparent from the following detailed description of preferred embodiments of the present disclosure with reference to the attached drawings.

DETAILED DESCRIPTION

A male connector, a female connector, and a connector set according to an embodiment of the present disclosure will be described hereinafter.

Configuration of Female Connector

Figure 1:
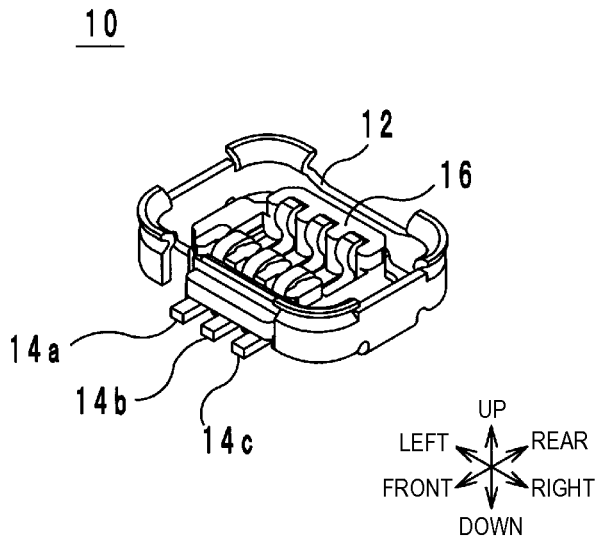
FIG. 1 is an external perspective view of a female connector.
Figure 2A:
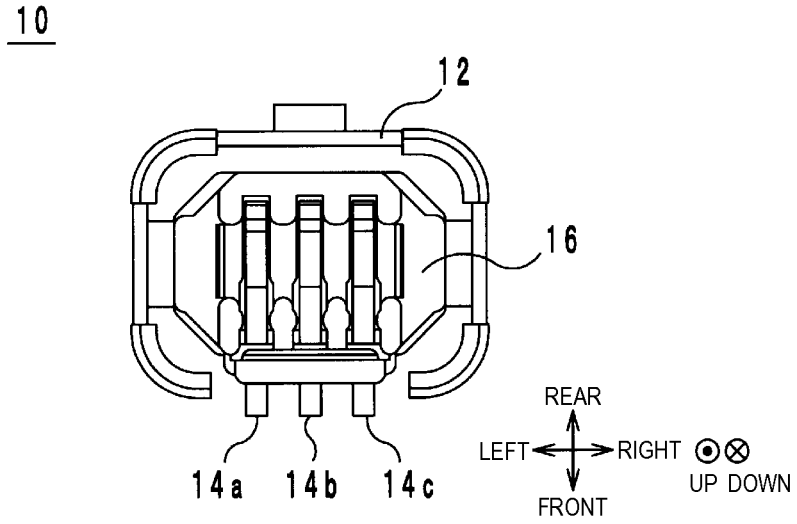
FIG. 2A is a diagram illustrating a view of the female connector from above.
Figure 2B:
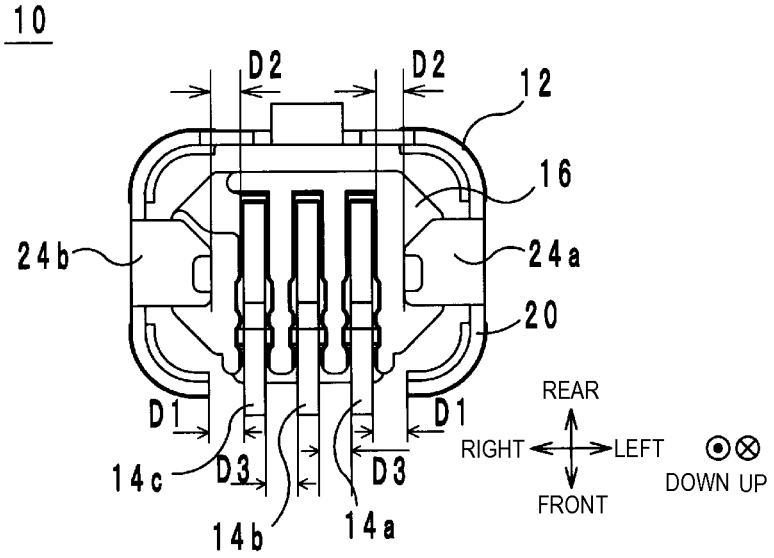
FIG. 2B is a diagram illustrating a view of the female connector from below.
Figure 2C:
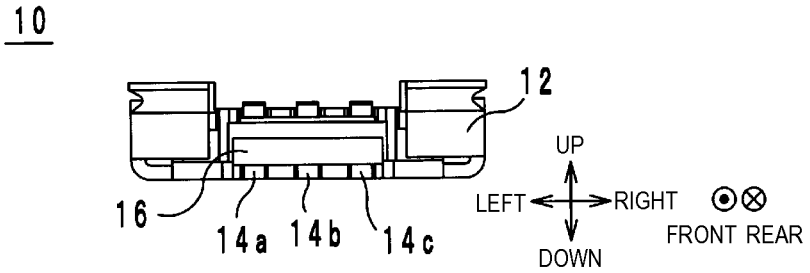
FIG. 2C is a diagram illustrating a view of the female connector from the front.
Figure 3A:
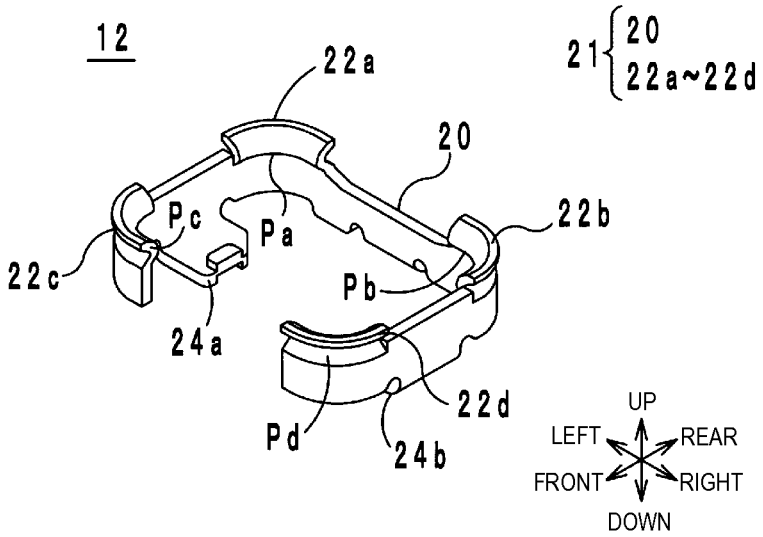
FIG. 3A is an external perspective view of an anchoring terminal 12.
Figure 3B:
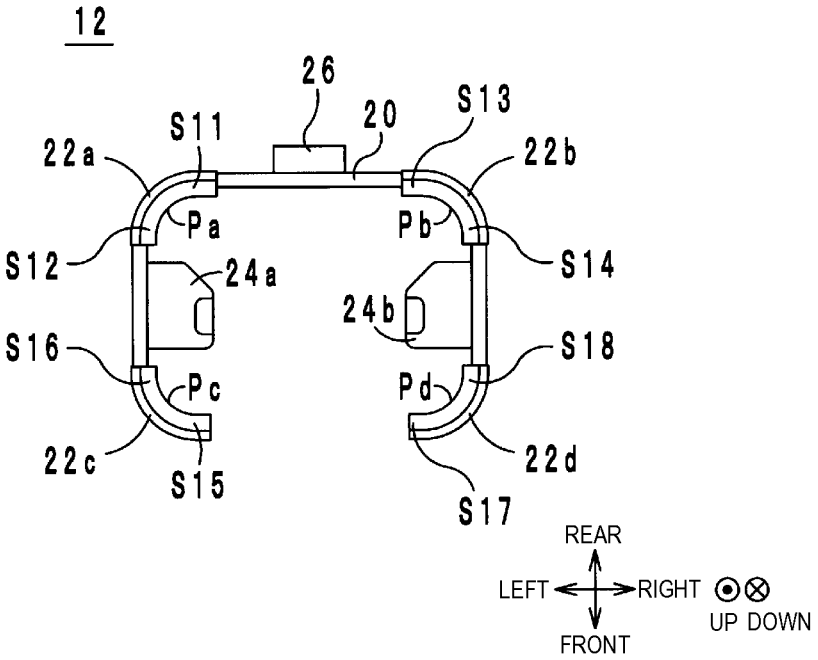
FIG. 3B is a diagram illustrating a view of the anchoring terminal 12 from above.
Figure 4:
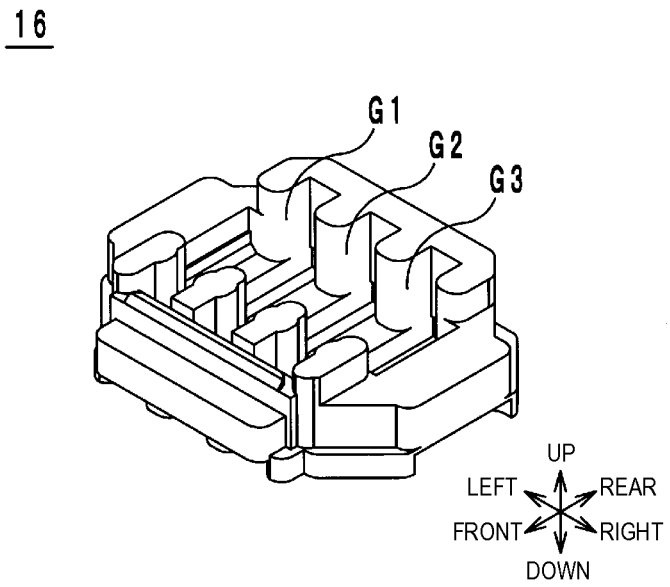
FIG. 4 is an external perspective view of an insulative member 16.
Figure 5:
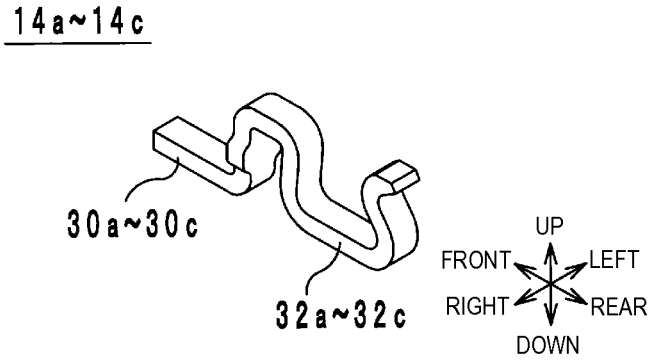
FIG. 5 is an external perspective view of connection terminals 14*a*-14*c*.

The configuration of a female connector (a first connector) in the connector set will be described first with reference to the drawings. FIG. 1 is an external perspective view of a female connector 10. FIG. 2A is a diagram illustrating a view of the female connector 10, facing toward the female connector 10 from a male connector 50 side along an engagement direction from above. FIG. 2B is a diagram illustrating a view of the female connector 10 from below. FIG. 2C is a diagram illustrating a view of the female connector 10 from the front. FIG. 3A is an external perspective view of an anchoring terminal 12. FIG. 3B is a diagram illustrating a view of the anchoring terminal 12 from above. FIG. 4 is an external perspective view of an insulative member 16. FIG. 5 is an external perspective view of connection terminals 14*a*-14*c*.

In the following, a direction of a center axis of the substantially ring-shaped anchoring terminal 12 shown in FIG. 1 will be called an up-down direction (a first direction). When the female connector 10 is viewed from above, a longer direction of the anchoring terminal 12 that has a substantially rectangular shape is defined as a left-right direction (a third direction), and a shorter direction of the anchoring terminal 12 is defined as a front-rear direction (a second direction).

The female connector 10 is mounted on a circuit board, a flexible wire, or the like, for example, and includes the anchoring terminal 12, the connection terminals 14*a*-14*c*, and the insulative member 16, as illustrated in FIG. 1 and FIGS. 2A-2C.

The anchoring terminal 12 is a conductor that is connected to a ground potential, and as illustrated in FIGS. 3A and 3B, has a shape that, when viewed from above, is a substantially rectangular ring with a part thereof cut out. The longer sides of the approximately rectangular ring extend in the left-right direction, whereas the shorter sides of the approximately rectangular ring extend in the front-rear direction. The anchoring terminal 12 is manufactured by bending a single metal plate, and is manufactured from, for example, a copper-based material such as phosphor bronze or the like.

The anchoring terminal 12 includes a main body portion 21, projection portions 24*a* and 24*b*, and a connecting portion 26. The main body portion 21 has a lower portion 20 and upper portions 22*a*-22*d*. The lower portion 20 is a substantially band-shaped conductor that encircles the perimeter of the center axis that extends in the up-down direction, and when viewed from above, has a shape in which part of a substantially rectangular ring has a part thereof cut out. In the present embodiment, the lower portion 20 has a shape in which part of the front-side longer side is cut out. However, the lower portion 20 still has a right-side shorter side, a left-side shorter side, a rear-side longer side, and part of the front-side longer side. In other words, the lower portion 20 has portions that follow the four sides of the substantially rectangular ring shape. In addition, the four corners of the lower portion 20 are rounded.

The upper portion 22*a* is connected to the top of the rear-left corner of the lower portion 20, and configures an upper end portion of the main body portion 21. When viewed from above, the upper portion 22*a* is substantially L-shaped. Note that the corner of the upper portion 22*a* is rounded. An inner peripheral surface of the upper portion 22*a* includes a surface S11 that faces the upper-front, and a surface S12 that faces the upper-right. Furthermore, the surface S11 and the surface S12 configure a convex curved surface.

Meanwhile, the surface S11 and the surface S12 project toward an inner side portion of the substantially rectangular ring shape, relative to the lower portion 20. As a result, a protruding portion Pa is provided at the rear-left corner of the inner peripheral surface of the main body portion 21.

The upper portion 22*b* is connected to the top of the rear-right corner of the lower portion 20, and configures an upper end portion of the main body portion 21. When viewed from above, the upper portion 22*b* is substantially L-shaped. Note that the corner of the upper portion 22*b* is rounded. An inner peripheral surface of the upper portion 22*b* includes a surface S13 that faces the upper-front, and a surface S14 that faces the upper-left. Furthermore, the surface S13 and the surface S14 configure a convex curved surface.

Meanwhile, the surface S13 and the surface S14 project toward the inner side portion of the substantially rectangular ring shape, relative to the lower portion 20. As a result, a protruding portion Pb is provided at the rear-right corner of the inner peripheral surface of the main body portion 21.

The upper portion 22*c* is connected to the top of the front-left corner of the lower portion 20, and configures an upper end portion of the main body portion 21. When viewed from above, the upper portion 22*c* is substantially L-shaped. Note that the corner of the upper portion 22*c* is rounded. An inner peripheral surface of the upper portion 22*c* includes a surface S15 that faces the upper-rear, and a surface S16 that faces the upper-right. Furthermore, the surface S15 and the surface S16 configure a convex curved surface.

Meanwhile, the surface S15 and the surface S16 project toward the inner side portion of the substantially rectangular ring shape, relative to the lower portion 20. As a result, a protruding portion Pc is provided at the front-left corner of the inner peripheral surface of the main body portion 21.

The upper portion 22*d* is connected to the top of the front-right corner of the lower portion 20, and configures an upper end portion of the main body portion 21. When viewed from above, the upper portion 22*d* is substantially L-shaped. Note that the corner of the upper portion 22*d* is rounded. An inner peripheral surface of the upper portion 22*d* includes a surface S17 that faces the upper-rear, and a surface S18 that faces the upper-left. Furthermore, the surface S17 and the surface S18 configure a convex curved surface.

Meanwhile, the surface S17 and the surface S18 project toward the inner side portion of the substantially rectangular ring shape, relative to the lower portion 20. As a result, a protruding portion Pd is provided at the front-right corner of the inner peripheral surface of the main body portion 21.

The projection portion 24*a* is connected to a lower end portion of the left shorter side of the lower portion 20, and is bent toward the right, relative to the lower portion 20. The projection portion 24*b* is connected to a lower end portion of the right shorter side of the lower portion 20, and is bent toward the left, relative to the lower portion 20. Accordingly, when viewed from above, the projection portions 24*a* and 24*b* project toward the inner side portion of the substantially rectangular ring.

The connecting portion 26 is connected to a lower end portion of the rear longer side of the lower portion 20, and is bent toward the rear relative to the lower portion 20.

The insulative member 16 is a block having a substantially octagonal shape when viewed from above, and is manufactured from an insulative resin such as a liquid-crystal polymer or the like. The insulative member 16 holds the anchoring terminal 12 and the connection terminals 14*a*-14*c*. Grooves G1-G3 that extend in the front-rear direction are provided in an upper surface of the insulative member 16. The grooves G1-G3 are arranged in that order from the left side to the right side. The grooves G1-G3 pass through the insulative member 16 in the up-down direction. As illustrated in FIGS. 2A and 2B, the insulative member 16 is enclosed within the main body portion 21 when viewed from above. Meanwhile, leading end portions of the projection portions 24*a* and 24*b* penetrate the insulative member 16. In other words, the insulative member 16 holds the anchoring terminal 12 only on the projection portions 24*a* and 24*b*. As a result, a gap is provided between the main body portion 21 and the insulative member 16 when viewed from above. The connection terminals being connected to a signal potential refers to the connection terminals being hard-wired so that a signal is transmitted therethrough.

Each of the connection terminals 14*a*-14*c* is a conductor that is connected to a signal potential or a ground potential. In the present embodiment, the connection terminals 14*a* and 14*c* located on both ends in the left-right direction are signal terminals to which a signal is supplied. Meanwhile, the connection terminal 14*b* is a ground terminal that is connected to a ground potential. Accordingly, with the connection terminals 14*a*-14*c*, the signal terminals and the ground terminal are disposed in an alternating manner. As illustrated in FIG. 5, the connection terminals 14*a*-14*c* are manufactured by bending a single substantially rod-shaped conductor, and are manufactured from a copper-based material such as phosphor bronze or the like. The connection terminals 14*a*-14*c* include connection portions 30*a*-30*c* and contact portions 32*a*-32*c*.

When viewed from the right, the contact portions 32*a*-32*c* have substantially U shapes whose upper sides are open. End portions of the contact portions 32*a*-32*c* on the upper rear are bent slightly toward the rear. End portions of the contact portions 32*a*-32*c* on the upper front are bent slightly toward the front. The connection portions 30*a*-30*c* are connected to end portions on the upper fronts of the contact portions 32*a*-32*c*, respectively. The connection portions 30*a*-30*c* are each substantially L-shaped when viewed from the right, and extend downward from the upper-front end portions of the contact portions 32*a*-32*c* before extending toward the front. In other words, the connection terminals 14*a*-14*c* extend toward the front from the contact portions 32*a*-32*c*, respectively, when viewed from above.

The connection terminals 14*a*-14*c* configured as described above are attached to the grooves G1-G3, respectively. Specifically, the connection terminals 14*a*-14*c* are inserted into the grooves G1-G3, respectively, from below. As a result, the contact portions 32*a*-32*c* of the connection terminals 14*a*-14*c* are arranged in that order, in a single row, from the left to the right within the substantially rectangular ring, when viewed from above.

Meanwhile, the connection portions 30*a*-30*c* of the connection terminals 14*a*-14*c* project toward the front below the insulative member 16. Here, when viewed from above, part of the longer side on the front of the anchoring terminal 12 is cut out. As illustrated in FIGS. 2A and 2B, the connection terminals 14*a*-14*c* are drawn out to an outer side portion of the substantially rectangular ring (that is, the anchoring terminal 12) via the cut-out portion in the anchoring terminal 12, when viewed from above.

Meanwhile, as illustrated in FIG. 2B, a minimum distance D1 between the lower portion 20 and the connection terminal 14*a* and a minimum distance D2 between the projection portion 24*a* and the connection terminal 14*a* are substantially equal, when viewed from below. Likewise, the minimum distance D1 between the lower portion 20 and the connection terminal 14*c* and the minimum distance D2 between the projection portion 24*b* and the connection terminal 14*c* are substantially equal. Furthermore, a distance D3 between the connection terminal 14*a* and the connection terminal 14*b* and the distance D3 between the connection terminal 14*b* and the connection terminal 14*c* are substantially equal to the minimum distances D1 and D2.

The female connector 10 configured as described thus far is mounted on a circuit board. Specifically, the projection portions 24*a* and 24*b*, the connecting portion 26, and the connection portions 30*a*-30*c* are soldered to land electrodes provided on the circuit board.

Method for Manufacturing Female Connector

Next, a method for manufacturing the female connector 10 will be described with reference to the drawings. FIGS. 6 through 9 are perspective views of the female connector 10 during manufacture.

Figure 6:
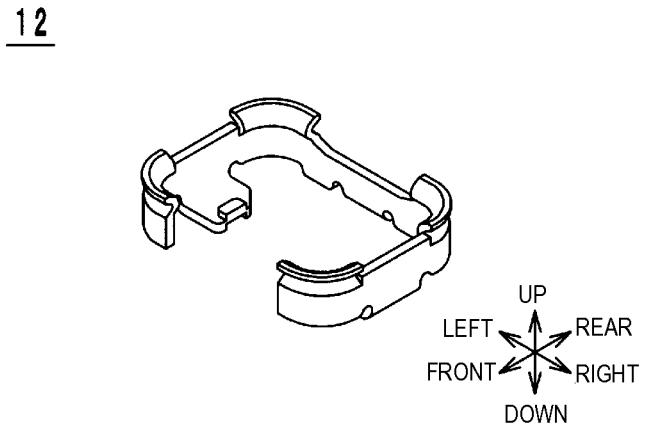
FIG. 6 is a perspective view of the female connector during manufacture.

First, as illustrated in FIG. 6, the anchoring terminal 12 is prepared. The anchoring terminal 12 is manufactured by, for example, bending a copper-based material such as phosphor bronze or the like.

Figure 7:
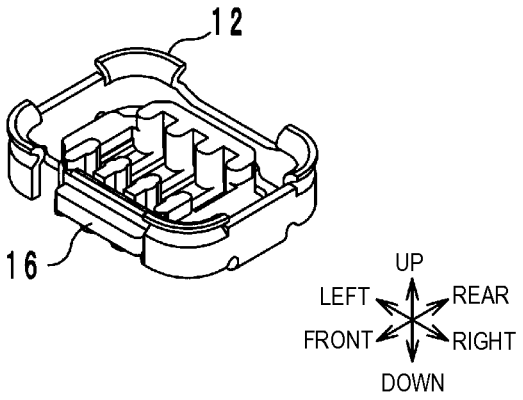
FIG. 7 is a perspective view of the female connector during manufacture.

Next, as illustrated in FIG. 7, the insulative member is formed through injection molding. At this time, the anchoring terminal 12 is disposed so that the leading end portions of the projection portions 24*a* and 24*b* of the anchoring terminal 12 are embedded in the insulative member 16, and the insulative member 16 is formed integrally with the anchoring terminal 12 through insert molding.

Figure 8:
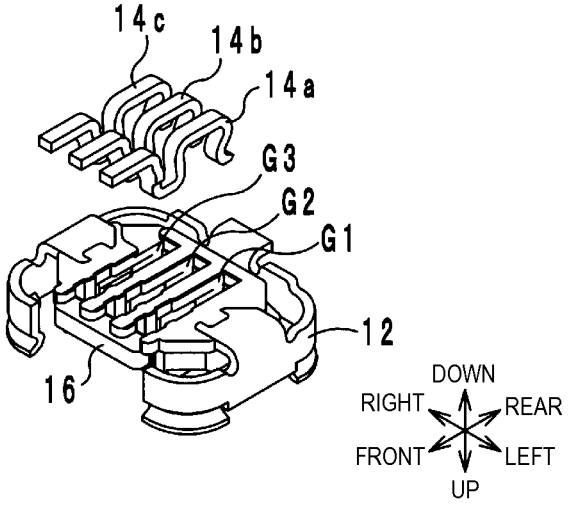
FIG. 8 is a perspective view of the female connector during manufacture.
Figure 9:
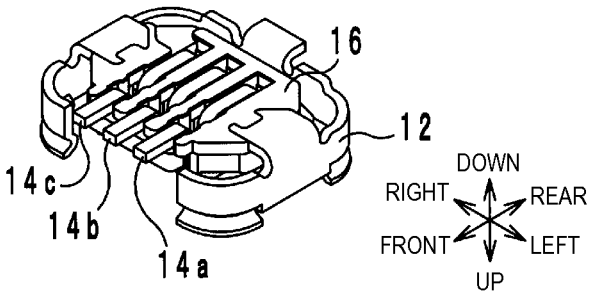
FIG. 9 is a perspective view of the female connector during manufacture.

Next, as illustrated in FIGS. 8 and 9, the connection terminals 14*a*-14*c* are inserted into the grooves G1-G3, respectively, from below, and are attached to the insulative member 16. Note that the connection terminals 14*a*-14*c* are not formed integrally with the insulative member 16. Accordingly, the connection terminals 14*a*-14*c* can deform slightly through their own elasticity. The female connector 10 is completed through the aforementioned process.

Configuration of Male Connector

Figure 10:
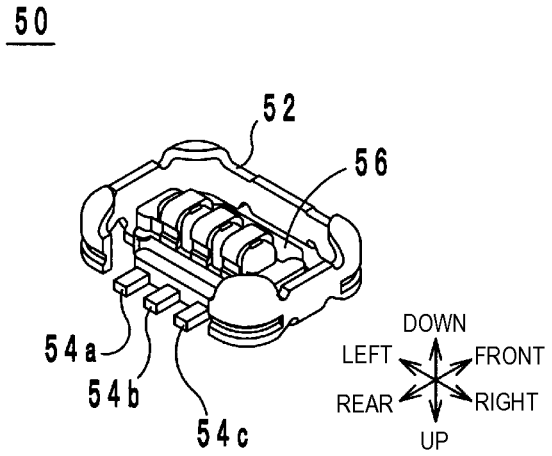
FIG. 10 is an external perspective view of a male connector.
Figure 11A:
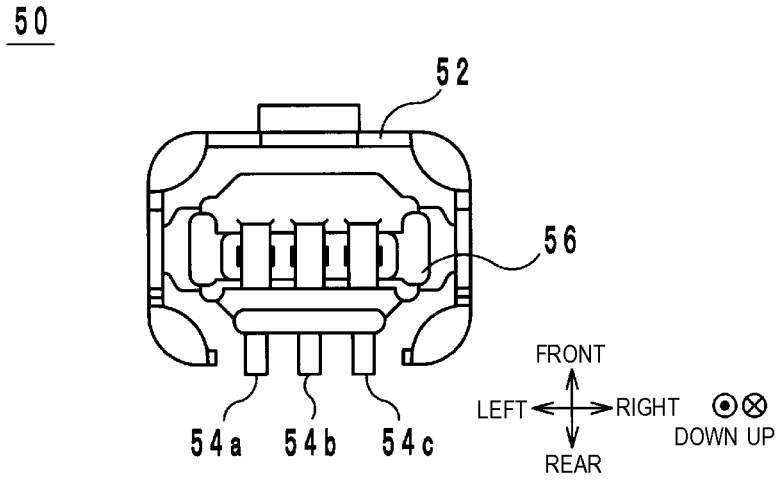
FIG. 11A is a diagram illustrating a view of the male connector, facing toward the male connector from the female connector side along an engagement direction from below.
Figure 11B:
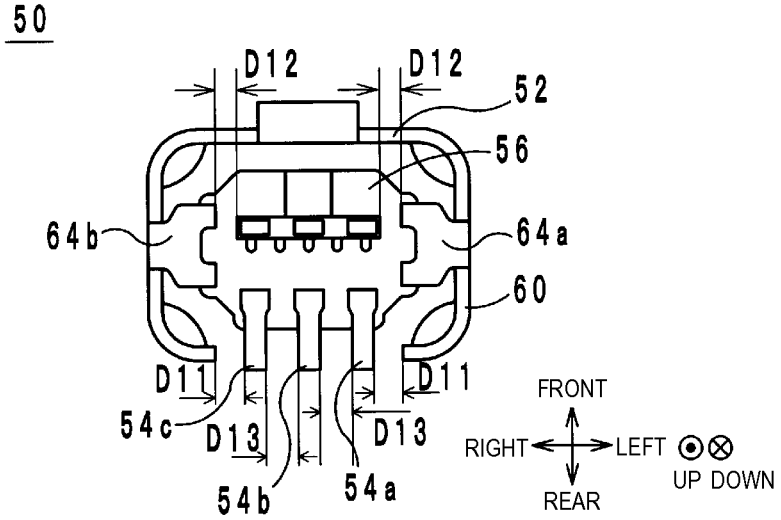
FIG. 11B is a diagram illustrating a view of the male connector from above.
Figure 11C:
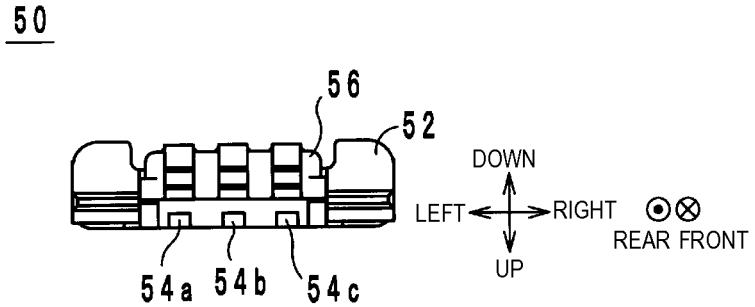
FIG. 11C is a diagram illustrating a view of the male connector from the front.
Figure 12A:
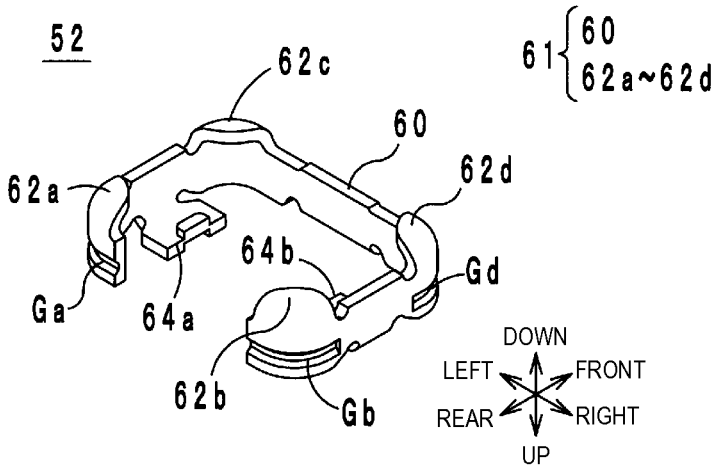
FIG. 12A is an external perspective view of an anchoring terminal 52.
Figure 12B:
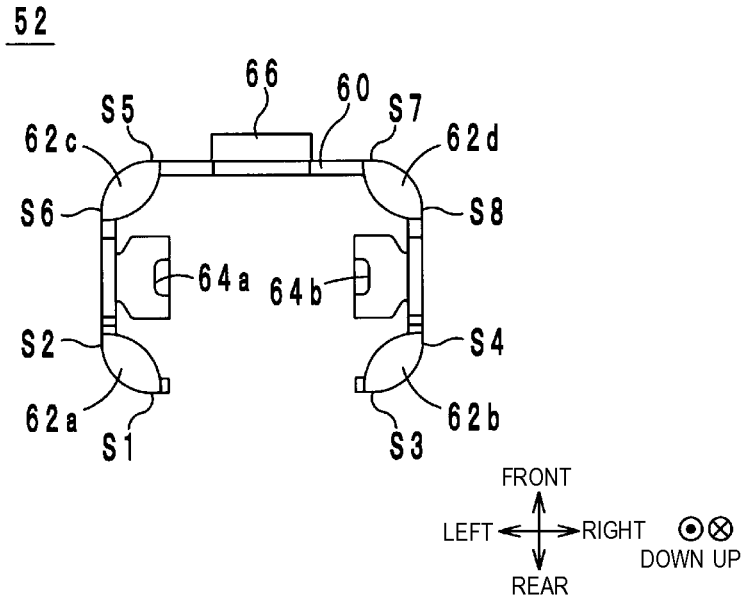
FIG. 12B is a diagram illustrating a view of the anchoring terminal 52 from below.
Figure 13:
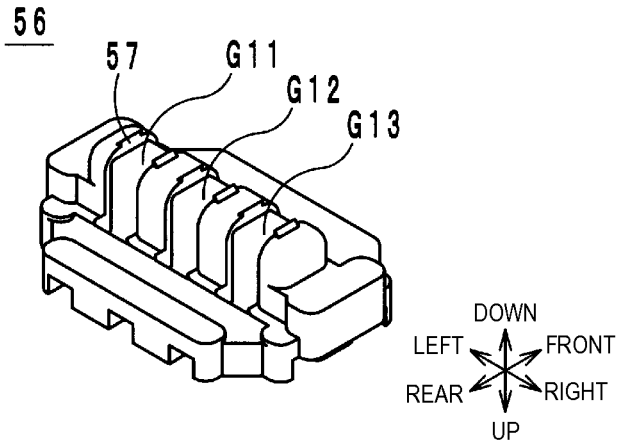
FIG. 13 is an external perspective view of an insulative member 56.
Figure 14:
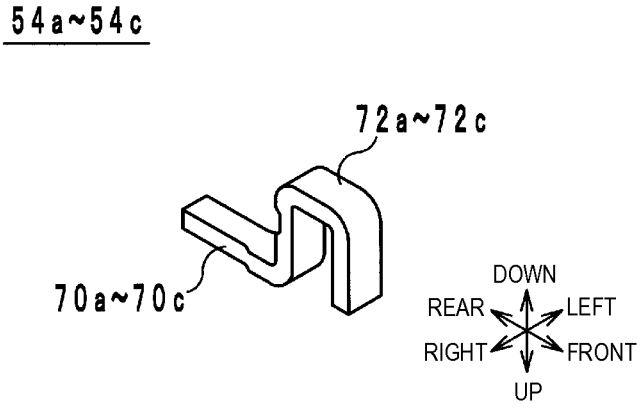
FIG. 14 is an external perspective view of connection terminals 54*a*-54*c*.

The configuration of a male connector (a second connector) in the connector set will be described next with reference to the drawings. FIG. 10 is an external perspective view of the male connector 50. FIG. 11A is a diagram illustrating a view of the male connector 50, facing toward the male connector 50 from the female connector 10 side along the engagement direction from below. FIG. 11B is a diagram illustrating a view of the male connector 50 from above. FIG. 11C is a diagram illustrating a view of the male connector 50 from the front. FIG. 12A is an external perspective view of an anchoring terminal 52. FIG. 12B is a diagram illustrating a view of the anchoring terminal 52 from below. FIG. 13 is an external perspective view of an insulative member 56. FIG. 14 is an external perspective view of connection terminals 54*a*-54*c*.

In the following, a direction in which the male connector 50 illustrated in FIG. 10 engages with the female connector 10 is taken as the up-down direction. However, note that in FIG. 10, the top and bottom are inverted relative to FIG. 1. Meanwhile, when the male connector 50 is viewed from below, the longer direction is defined as the left-right direction and the shorter direction is defined as the front-rear direction. However, note that in FIG. 10, the front-rear direction is also inverted relative to FIG. 1. In other words, the front-rear direction, left-right direction, and up-down direction axes in FIG. 10 correspond to the front-rear direction, left-right direction, and up-down direction axes in FIG. 1 being rotated by 180 degrees central to the left-right direction axis.

The male connector 50 is mounted on a circuit board, a flexible wire, or the like, for example, and includes the anchoring terminal 52, the connection terminals 54*a*-54*c*, and the insulative member 56, as illustrated in FIG. 10 and FIGS. 11A-11C.

The anchoring terminal 52 is a conductor that is connected to a ground potential, and as illustrated in FIGS. 12A and 12B, has a shape that, when viewed from below, is a substantially rectangular ring with a part thereof cut out. The longer sides of the approximately rectangular ring corresponding to the substantially rectangular anchoring terminal 52 extend in the left-right direction, whereas the shorter sides of the approximately rectangular ring extend in the front-rear direction. The anchoring terminal 52 is manufactured by bending a single metal plate, and is manufactured from, for example, a copper-based material such as phosphor bronze or the like.

The anchoring terminal 52 includes a main body portion 61, projection portions 64*a* and 64*b*, and a connecting portion 66. The main body portion 61 has an upper portion 60 and lower portions 62*a*-62*d*. The upper portion 60 is a substantially band-shaped conductor that encircles the perimeter of the center axis that extends in the up-down direction, and when viewed from above, has a shape in which part of a substantially rectangular ring has a part thereof cut out. In the present embodiment, the upper portion 60 has a shape in which part of the rear-side longer side is cut out. However, the upper portion 60 still has a right-side shorter side, a left-side shorter side, a front-side longer side, and part of the rear-side longer side. In other words, the upper portion 60 has portions that follow the four sides of the substantially rectangular ring shape. In addition, the four corners of the upper portion 60 are rounded.

Meanwhile, as illustrated in FIG. 12A, recessed portions Ga-Gd are provided in the respective four corners of an outer peripheral surface of the upper portion 60 (the recessed portion Gc is not illustrated). More specifically, the recessed portion Ga is provided in a rear-left corner in the outer peripheral surface of the upper portion 60. The recessed portion Gb is provided in a rear-right corner in the outer peripheral surface of the upper portion 60. The recessed portion Gc is provided in a front-left corner in the outer peripheral surface of the upper portion 60. The recessed portion Gd is provided in a front-right corner in the outer peripheral surface of the upper portion 60.

The lower portion 62*a* is connected to the bottom of the rear-left corner of the upper portion 60, and configures a lower end portion of the main body portion 61. The lower portion 62*a* has a substantially oval shape obtained by combining two quarter-circles, when viewed from below. An outer peripheral surface of the lower portion 62*a* includes a surface S1 that faces the lower-rear and a surface S2 that faces the lower-left. Furthermore, the surface S1 and the surface S2 configure a single convex curved surface.

The lower portion 62*b* is connected to the bottom of the rear-right corner of the upper portion 60, and configures a lower end portion of the main body portion 61. The lower portion 62*b* has a substantially oval shape obtained by combining two quarter-circles, when viewed from below. An outer peripheral surface of the lower portion 62*b* includes a surface S3 that faces the lower-rear and a surface S4 that faces the lower-right. Furthermore, the surface S3 and the surface S4 configure a single convex curved surface.

The lower portion 62*c* is connected to the bottom of the front-left corner of the upper portion 60, and configures a lower end portion of the main body portion 61. The lower portion 62*c* has a substantially oval shape obtained by combining two quarter-circles, when viewed from below. An outer peripheral surface of the lower portion 62*c* includes a surface S5 that faces the lower-front and a surface S6 that faces the lower-left. Furthermore, the surface S5 and the surface S6 configure a single convex curved surface.

The lower portion 62*d* is connected to the bottom of the front-right corner of the upper portion 60, and configures a lower end portion of the main body portion 61. The lower portion 62*d* has a substantially oval shape obtained by combining two quarter-circles, when viewed from below. An outer peripheral surface of the lower portion 62*d* includes a surface S7 that faces the lower-front and a surface S8 that faces the lower-right. Furthermore, the surface S7 and the surface S8 configure a single convex curved surface.

The projection portion 64*a* is connected to an upper end portion of the left shorter side of the upper portion 60, and is bent toward the right, relative to the upper portion 60. The projection portion 64*b* is connected to an upper end portion of the right shorter side of the upper portion 60, and is bent toward the left, relative to the upper portion 60. Accordingly, when viewed from above, the projection portions 64*a* and 64*b* project toward the inner side portion of the substantially rectangular ring.

The connecting portion 66 is connected to the upper end portion of the front longer side of the upper portion 60, and is bent toward the front relative to the upper portion 60.

The insulative member 56 is a block having a substantially octagonal shape when viewed from above, and is manufactured from an insulative resin such as a liquid-crystal polymer or the like. The insulative member 56 holds the anchoring terminal 52 and the connection terminals 54*a*-54*c*. A substantially strip-shaped projection 57 that extends in the left-right direction is provided in a bottom surface of the insulative member 56. Furthermore, grooves G11-G13 that extend in the front-rear direction are provided in the projection 57. The grooves G11-G13 are arranged in that order from the left side to the right side. As illustrated in FIGS. 11A and 11B, the insulative member 56 is enclosed within the main body portion 61 when viewed from above. Meanwhile, leading end portions of the projection portions 64*a* and 64*b* penetrate the insulative member 56. In other words, the insulative member 56 holds the anchoring terminal 52 only via the projection portions 64*a* and 64*b*. As a result, a gap is provided between the main body portion 61 and the insulative member 56 when viewed from above.

Each of the connection terminals 54*a*-54*c* is a conductor that is connected to a signal potential or a ground potential. In the present embodiment, the connection terminals 54*a* and 54*c* located on both ends in the left-right direction are signal terminals to which a signal is supplied. Meanwhile, the connection terminal 54*b* is a ground terminal to which a ground potential is connected. Accordingly, with the connection terminals 54*a*-54*c*, the signal terminals and the ground terminal are disposed in an alternating manner. As illustrated in FIG. 14, the connection terminals 54*a*-54*c* are manufactured by bending a single substantially rod-shaped conductor, and are manufactured from a copper-based material such as phosphor bronze or the like. The connection terminals 54*a*-54*c* include connection portions 70*a*-70*c* and contact portions 72*a*-72*c*.

When viewed from the right, the contact portions 72*a*-72*c* have substantially U shapes whose upper sides are open. The connection portions 70*a*-70*c* are connected to end portions on the upper rear of the contact portions 72*a*-72*c*, respectively. The connection portions 70*a*-70*c* each have substantially straight line shapes when viewed from the right, and extend rearward from the upper-rear end portions of the contact portions 72*a*-72*c*, respectively. In other words, the connection terminals 54*a*-54*c* extend toward the rear from the contact portions 72*a*-72*c*, respectively, when viewed from below.

The connection terminals 54*a*-54*c* configured as described above are attached to the grooves G11-G13, respectively. Specifically, the connection terminals 54*a*-54*c* are attached to the insulative member 56 so that following end portions of the connection portions 70*a*-70*c* and the outer peripheral surfaces of the contact portions 72*a*-72*c* are exposed from the insulative member 56. As a result, the contact portions 72*a*-72*c* of the connection terminals 54*a*-54*c* are arranged in that order, in a single row, from the left to the right within the substantially rectangular ring, when viewed from below.

Meanwhile, the connection portions 70*a*-70*c* of the connection terminals 54*a*-54*c* project toward the rear below the insulative member 56. Here, when viewed from above, part of the longer side on the rear of the anchoring terminal 52 is cut out. As illustrated in FIGS. 11A and 11B, the connection terminals 54*a*-54*c* are drawn out to an outer side portion of the substantially rectangular ring (that is, the anchoring terminal 52) via the cut-out portion in the anchoring terminal 52, when viewed from above.

Meanwhile, as illustrated in FIG. 11B, a minimum distance D11 between the upper portion 60 and the connection terminal 54*a* and a minimum distance D12 between the projection portion 64*a* and the connection terminal 54*a* are substantially equal, when viewed from above. Likewise, the minimum distance D11 between the upper portion 60 and the connection terminal 54*c* and the minimum distance D12 between the projection portion 64*b* and the connection terminal 54*c* are substantially equal. Furthermore, a distance D13 between the connection terminal 54*a* and the connection terminal 54*b* and the distance D13 between the connection terminal 54*b* and the connection terminal 54*c* are substantially equal to the minimum distances D11 and D12.

The male connector 50 configured as described thus far is mounted on a circuit board. Specifically, the projection portions 64*a* and 64*b*, the connecting portion 66, and the connection portions 70*a*-70*c* are soldered to land electrodes provided on the circuit board.

Method for Manufacturing Male Connector

Figure 15:
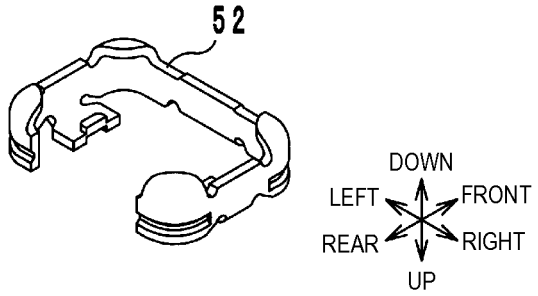
FIG. 15 is a perspective view of the male connector during manufacture.
Figure 16:
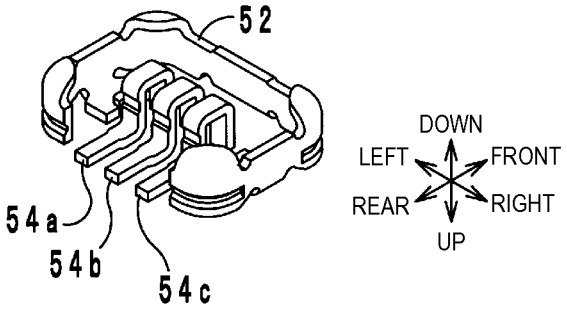
FIG. 16 is a perspective view of the male connector during manufacture.
Figure 17:
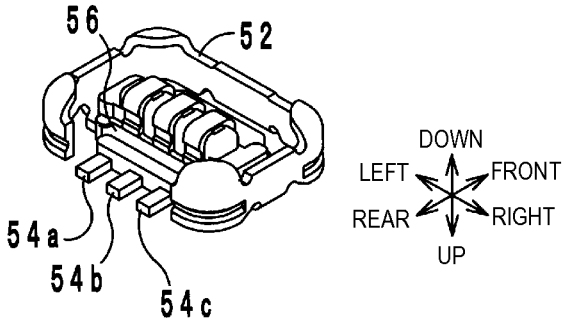
FIG. 17 is a perspective view of the male connector during manufacture.

Next, a method for manufacturing the male connector 50 will be described with reference to the drawings. FIGS. 15 through 17 are perspective views of the male connector 50 during manufacture.

First, as illustrated in FIG. 15, the anchoring terminal 52 is prepared. The anchoring terminal 52 is manufactured by, for example, bending a copper-based material such as phosphor bronze or the like.

Next, as illustrated in FIG. 16, the connection terminals 54*a*-54*c* are disposed within the anchoring terminal 52.

Next, as illustrated in FIG. 17, the insulative member 56 is formed through injection molding. At this time, the insulative member 56 is formed integrally with the anchoring terminal 52 and the connection terminals 54*a*-54*c* through insert molding so that the leading end portions of the projection portions 64*a* and 64*b* of the anchoring terminal 52 are embedded in the insulative member 56 and the connection terminals 54*a*-54*c* are partially embedded in the insulative member 56. The connection terminals 54*a*-54*c* are formed integrally with the insulative member 16 and thus experience almost no deformation. The male connector 50 is completed through the aforementioned process.

Configuration of a Connector Set

Figure 18A:
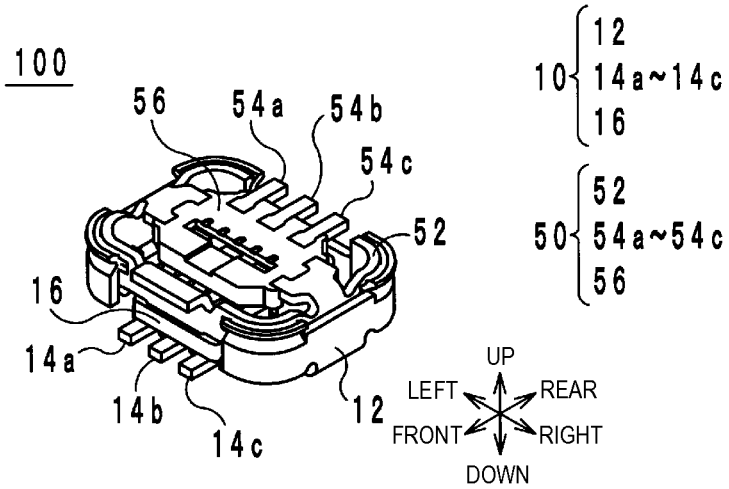
FIG. 18A is an external perspective view of a connector set.
Figure 18B:
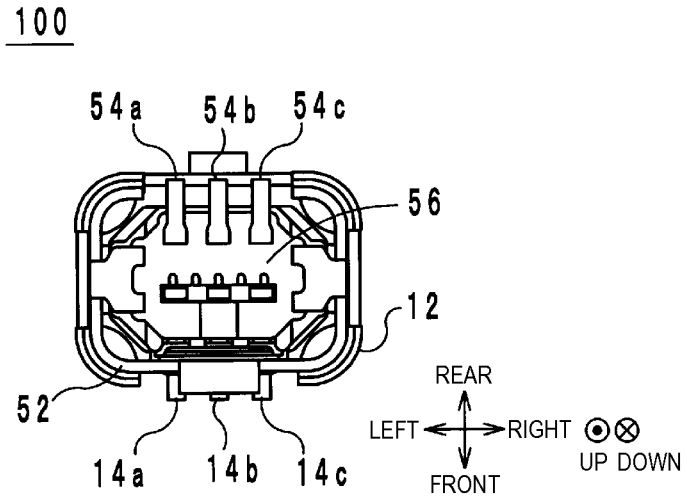
FIG. 18B is a diagram illustrating a view of the connector set from above.
Figure 18C:
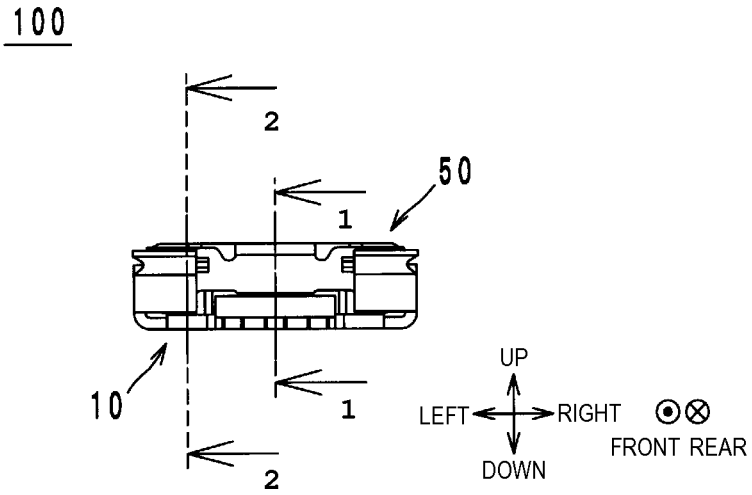
FIG. 18C is a diagram illustrating a view of the connector set from the front.
Figure 18D:
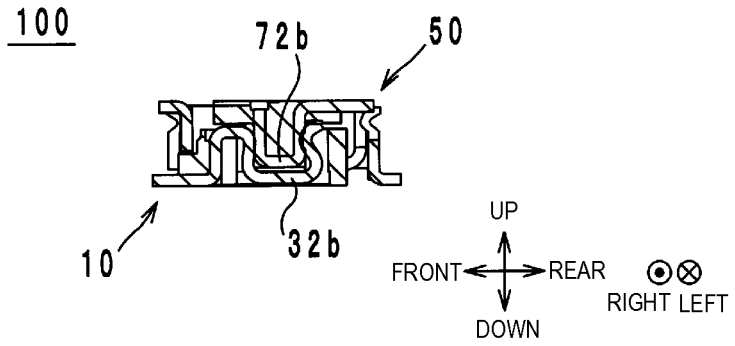
FIG. 18D is a cross-sectional structural diagram illustrating the connector set along a line 1-1 in FIG. 18C.
Figure 18E:
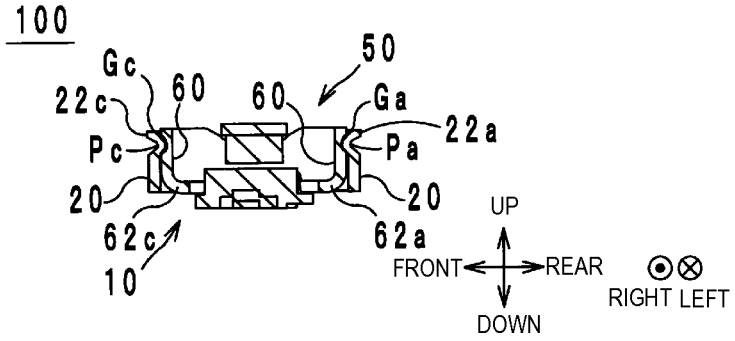
FIG. 18E is a cross-sectional structural diagram illustrating the connector set along a line 2-2 in FIG. 18C.

Next, the configuration of a connector set 100 will be described with reference to the drawings. FIG. 18A is an external perspective view of the connector set 100. FIG. 18B is a diagram illustrating a view of the connector set 100 from above. FIG. 18C is a diagram illustrating a view of the connector set 100 from the front. FIG. 18D is a cross-sectional structural diagram illustrating the connector set 100 along a line 1-1 in FIG. 18C. FIG. 18E is a cross-sectional structural diagram illustrating the connector set 100 along a line 2-2 in FIG. 18C.

The connector set 100 includes the female connector 10 and the male connector 50, and relays the transmission of high-frequency signals (approximately 6 GHz) between circuit boards. As illustrated in FIGS. 18A-18E, the anchoring terminal 52 of the male connector 50 is inserted into the anchoring terminal 12 of the female connector 10 from above when coupling the female connector 10 and the male connector 50. The inner peripheral surface of the lower portion 20 in the female connector 10 is formed to be slightly smaller than the outer peripheral surface of the upper portion 60 in the male connector 50, when viewed from above. Accordingly, the outer peripheral surface of the upper portion 60 in the anchoring terminal 52 presses against the inner peripheral surface of the lower portion 20 in the anchoring terminal 12. Furthermore, the protruding portions Pa-Pd engage with the recessed portions Ga-Gd, respectively. As a result, the anchoring terminals 12 and 52 maintain the coupling between the female connector 10 and the male connector 50.

The contact portions 72*a*-72*c* of the connection terminals 54*a*-54*c* are inserted into the contact portions 32*a*-32*c* of the connection terminals 14*a*-14*c*, respectively. Specifically, the contact portions 72*a*-72*c* are inserted into the contact portions 32*a*-32*c* from above, via respective upward-facing openings in the contact portions 32*a*-32*c*. As described earlier, the insulative member 16 is not formed integrally with the contact portions 32*a*-32*c*. Accordingly, when the contact portions 72*a*-72*c* are inserted into the contact portions 32*a*-32*c*, respectively, the contact portions 32*a*-32*c* are able to elastically deform and widen slightly in the front-rear direction. As a result, the inner peripheral surfaces of the contact portions 32*a*-32*c* press against the outer peripheral surfaces of the contact portions 72*a*-72*c*, respectively.

As described above, the connection terminal 14*a* and the connection terminal 54*a* make contact at the contact portions 32*a* and 72*a* when the female connector 10 and the male connector 50 are coupled. Likewise, the connection terminal 14*b* and the connection terminal 54*b* make contact at the contact portions 32*b* and 72*b* when the female connector 10 and the male connector 50 are coupled. Furthermore, the connection terminal 14*c* and the connection terminal 54*c* make contact at the contact portions 32*c* and 72*c* when the female connector 10 and the male connector 50 are coupled.

Meanwhile, the anchoring terminal 12 and the anchoring terminal 52 have substantially rectangular ring shapes that enclose the contact portions 32*a*-32*c* and 72*a*-72*c* when the female connector 10 and the male connector 50 are coupled, when viewed from above. More specifically, when viewed from above, the main body portion 21 of the anchoring terminal 12 has a shape in which part of the longer side on the front of the substantially rectangular ring is cut out. On the other hand, when viewed from above, the main body portion 61 of the anchoring terminal 52 has a shape in which part of the longer side on the rear of the substantially rectangular ring is cut out. In other words, the cut-out portion of the anchoring terminal 12 and the cut-out portion of the anchoring terminal 52 are provided in different positions so as not to overlap when viewed from above. Accordingly, when the anchoring terminal 52 is inserted into the anchoring terminal 12, the anchoring terminal 12 and the anchoring terminal 52 configure a substantially rectangular ring. Meanwhile, the contact portions 32*a*-32*c* are arranged in that order, in a single row, from the left to the right within the substantially rectangular ring, when viewed from above. The contact portions 72*a*-72*c* are arranged in that order, in a single row, from the left to the right within the substantially rectangular ring, when viewed from above.

Attachment of Male Connector to Female Connector

Figure 19A:
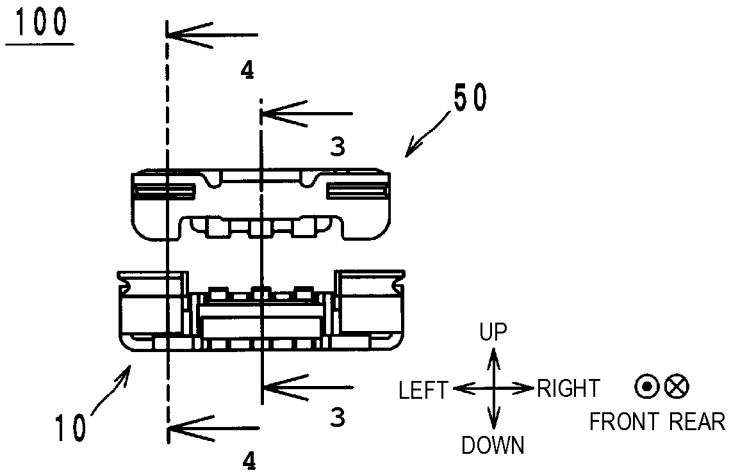
FIG. 19A is a diagram illustrating a view of the connector set from the front.
Figure 19B:
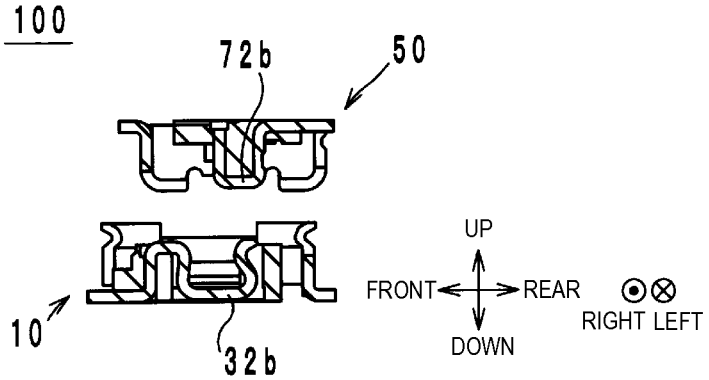
FIG. 19B is a cross-sectional structural diagram illustrating the connector set along a line 3-3 in FIG. 19A.
Figure 19C:
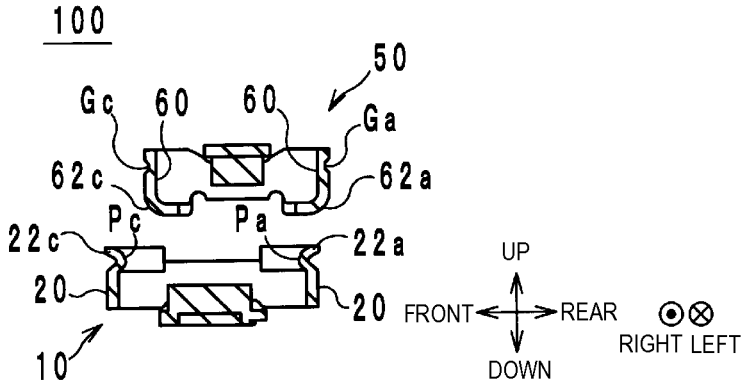
FIG. 19C is a cross-sectional structural diagram illustrating the connector set along a line 4-4 in FIG. 19A.
Figure 20A:
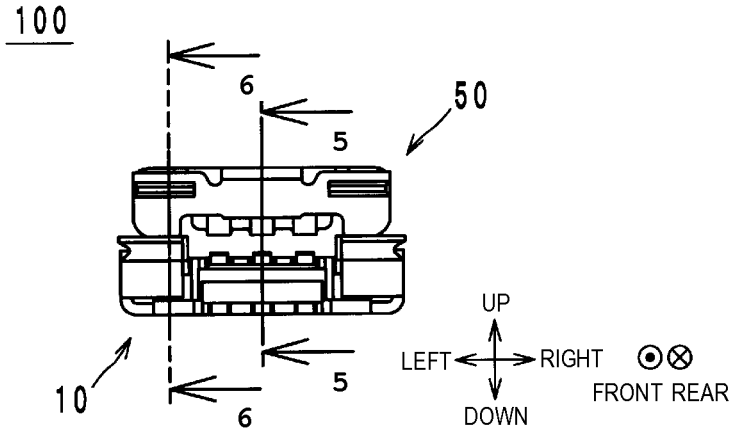
FIG. 20A is a diagram illustrating a view of the connector set from the front.
Figure 20B:
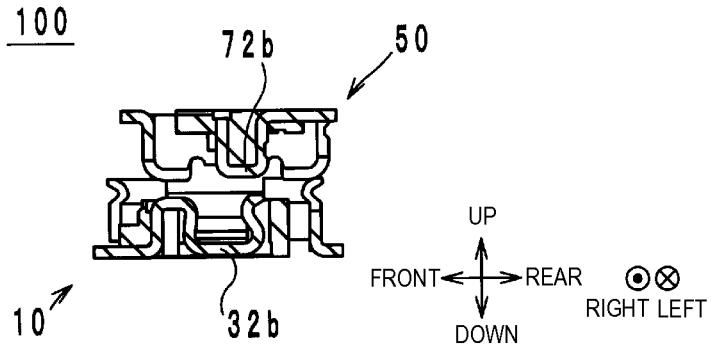
FIG. 20B is a cross-sectional structural diagram illustrating the connector set 100 along a line 5-5 in FIG. 20A.
Figure 20C:
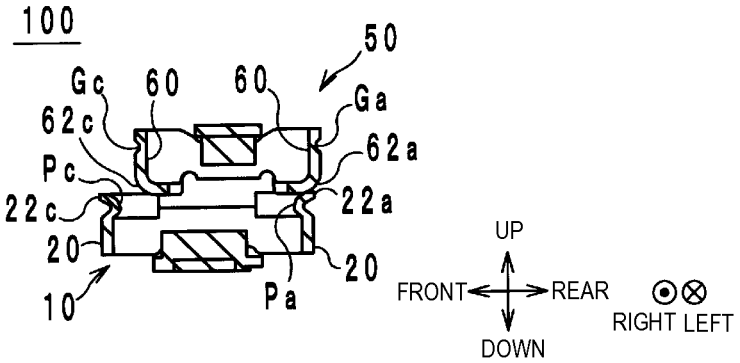
FIG. 20C is a cross-sectional structural diagram illustrating the connector set along a line 6-6 in FIG. 20A.
Figure 21A:
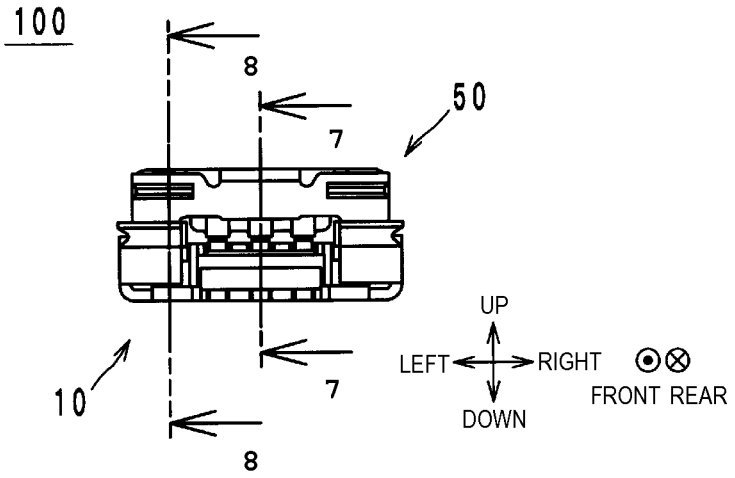
FIG. 21A is a diagram illustrating a view of the connector set from the front.
Figure 21B:
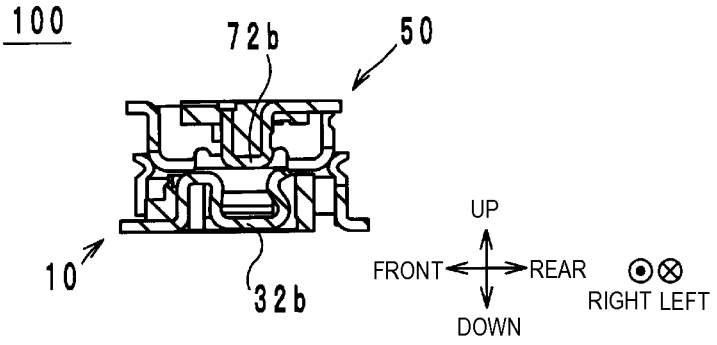
FIG. 21B is a cross-sectional structural diagram illustrating the connector set along a line 7-7 in FIG. 21A.
Figure 21C:
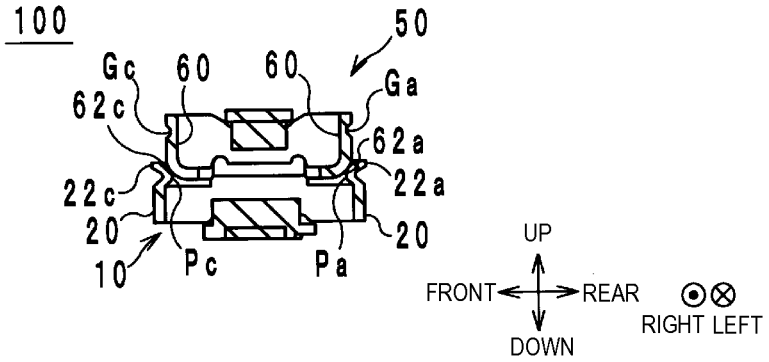
FIG. 21C is a cross-sectional structural diagram illustrating the connector set along a line 8-8 in FIG. 21A.

Next, the attachment of the male connector 50 to the female connector 10 will be described with reference to the drawings. FIG. 19A is a diagram illustrating a view of the connector set 100 from the front. FIG. 19B is a cross-sectional structural diagram illustrating the connector set 100 along a line 3-3 in FIG. 19A. FIG. 19C is a cross-sectional structural diagram illustrating the connector set 100 along a line 4-4 in FIG. 19A. FIG. 20A is a diagram illustrating a view of the connector set 100 from the front. FIG. 20B is a cross-sectional structural diagram illustrating the connector set 100 along a line 5-5 in FIG. 20A. FIG. 20C is a cross-sectional structural diagram illustrating the connector set 100 along a line 6-6 in FIG. 20A. FIG. 21A is a diagram illustrating a view of the connector set 100 from the front. FIG. 21B is a cross-sectional structural diagram illustrating the connector set 100 along a line 7-7 in FIG. 21A. FIG. 21C is a cross-sectional structural diagram illustrating the connector set 100 along a line 8-8 in FIG. 21A.

It is preferable for the male connector 50 to be lowered from directly above the female connector 10 and inserted into the female connector 10. However, there are also cases where the male connector 50 is lowered from a position that is skewed from the position corresponding to directly above the female connector 10. With the connector set 100 according to the present embodiment, the male connector 50 can be inserted into the female connector 10 even in the case where the male connector 50 is lowered from a position that is skewed from the position corresponding to directly above the female connector 10. A case in which the male connector 50 is lowered from a position skewed to the rear relative to the female connector 10 will be given as an example hereinafter, as illustrated in FIGS. 19A-19C.

When the male connector 50 is lowered from the state illustrated in FIGS. 19A-19C, the surfaces S11 and S13 of the upper portions 22*a* and 22*b* (see FIG. 3B) make contact with the surfaces S1 and S3 of the lower portions 62*a* and 62*b* (see FIG. 12B), respectively, as shown in FIGS. 20A-20C. The surfaces S11 and S13 have convex curved surfaces facing the upper-rear. The surfaces S1 and S3 have convex curved surfaces facing the lower-front. Accordingly, when the male connector 50 is lowered further, the male connector 50 slides along the surfaces S11 and S13 and moves toward the lower-front. As a result, the male connector 50 is positioned directly above the female connector 10, as illustrated in FIGS. 21A-21C. The male connector 50 is then inserted into the female connector 10 by lowering the male connector 50 further, as illustrated in FIGS. 18C-18E.

Note that the male connector 50 can be inserted into the female connector 10 for the same reasons as described above even in the case where the male connector 50 is lowered from a position skewed toward the front relative to the female connector 10, the case where the male connector 50 is lowered from a position skewed toward the right relative to the female connector 10, and the case where the male connector 50 is lowered from a position skewed toward the left relative to the female connector 10.

Effects

The connector set 100 according to the present embodiment can improve noise-resistance properties. More specifically, the anchoring terminal 12 and the anchoring terminal 52 have substantially rectangular ring shapes that enclose the contact portions 32*a*-32*c* and 72*a*-72*c* when the female connector 10 and the male connector 50 are coupled, when viewed from above. Meanwhile, the anchoring terminals 12 and 52 are connected to a ground potential. As such, the connection terminals 14*a*-14*c* and 54*a*-54*c* are shielded in the front-rear and left-right directions. Accordingly, noise is suppressed from entering the connection terminals 14*a*-14*c* and 54*a*-54*c* in the front-rear and left-right directions. As such, the connector set 100 can improve noise-resistance properties.

Meanwhile, in the connector set 100, the connection terminals 14*a*-14*c* and 54*a*-54*c* are shielded in the front-rear and left-right directions. As such, according to the connector set 100, noise can be suppressed from radiating from the connection terminals 14*a*-14*c* and 54*a*-54*c* from the front-rear and left-right directions.

In addition, the noise-resistance properties can be improved by the male connector 50 as well, due to the following reasons. Specifically, when viewed from above, the lower portion 20 of the anchoring terminal 12 has portions that follow the four sides of the substantially rectangular ring that encloses the contact portions 32*a*-32*c*, and has a shape in which part of the substantially rectangular ring has been cut out. Accordingly, with the male connector 50, the anchoring terminal 52 that is connected to a ground potential is present in the front-rear and left-right directions of the contact portions 32*a*-32*c*. As a result, the connection terminals 54*a*-54*c* are shielded in the front-rear and left-right directions. Accordingly, noise from the front-rear and left-right directions is suppressed from entering the connection terminals 54*a*-54*c*. As such, the male connector can improve noise-resistance properties. Note that the female connector 10 can also improve noise-resistance properties for the same reasons.

Meanwhile, in the male connector 50, the connection terminals 54*a*-54*c* are shielded in the front-rear and left-right directions. As such, according to the male connector 50, noise can be suppressed from radiating from the connection terminals 54*a*-54*c* in the front-rear and left-right directions. Note that in the female connector 10 as well, the connection terminals 14*a*-14*c* can be suppressed from radiating noise in the front-rear and left-right directions for the same reason.

Meanwhile, according to the female connector 10, the male connector 50, and the connector set 100, the connection terminals 14*a*-14*c* and 54*a*-54*c* can be suppressed from being damaged when the female connector 10 and the male connector 50 are coupled. Specifically, the anchoring terminal 12 of the female connector 10 has the upper portions 22*a* and 22*d*. The upper portion 22*a* is connected to the top of the rear-left corner of the lower portion 20, and configures an upper end portion of the main body portion 21. Furthermore, an inner peripheral surface of the upper portion 22*a* includes the surface S11 that faces the upper-front, and the surface S12 that faces the upper-right. The upper portion 22*d* is connected to the top of the front-right corner of the lower portion 20, and configures an upper end portion of the main body portion 21. Furthermore, an inner peripheral surface of the upper portion 22*d* includes the surface S17 that faces the upper-rear, and the surface S18 that faces the upper-left.

On the other hand, the anchoring terminal 52 of the male connector 50 has the lower portions 62*a* and 62*d*. The lower portion 62*a* is connected to the bottom of the rear-left corner of the upper portion 60, and configures a lower end portion of the main body portion 61. Furthermore, the outer peripheral surface of the lower portion 62*a* includes the surface S1 that faces the lower-rear and the surface S2 that faces the lower-left. The lower portion 62*d* is connected to the bottom of the front-right corner of the upper portion 60, and configures a lower end portion of the main body portion 61. Furthermore, the outer peripheral surface of the lower portion 62*d* includes the surface S7 that faces the lower-front and the surface S8 that faces the lower-right.

When the male connector 50 as described thus far is inserted into the female connector 10 from above, the surface S1 and the surface S11 make contact, the surface S2 and the surface S12 make contact, the surface S7 and the surface S17 make contact, and the surface S8 and the surface S18 make contact. Accordingly, the female connector 10 and the male connector 50 are positioned in the front-rear direction by the surfaces S1, S2, S11, and S12. Likewise, the female connector 10 and the male connector 50 are positioned in the left-right direction by the surfaces S7, S8, S17, and S18. In other words, the anchoring terminals 12 and 52 contribute greatly to the positioning of the female connector 10 and the male connector 50 in the front-rear and left-right directions, whereas the connection terminals 14*a*-14*c* and 54*a*-54*c* do not contribute greatly to this positioning. As such, according to the female connector 10, the male connector 50, and the connector set 100, the connection terminals 14*a*-14*c* and 54*a*-54*c* can be suppressed from being damaged when the female connector 10 and the male connector 50 are coupled.

Note that the anchoring terminal 52 has the lower portions 62*b* and 62*c* and the anchoring terminal 12 has the upper portions 22*b* and 22*c*. Accordingly, the upper portions 22*b* and 22*c* and the lower portions 62*b* and 62*c* also position the female connector 10 and the male connector 50 in the front-rear and left-right directions. As such, according to the female connector 10, the male connector 50, and the connector set 100, the connection terminals 14*a*-14*c* and 54*a*-54*c* can be suppressed from being damaged when the female connector 10 and the male connector 50 are coupled.

In addition, according to the male connector 50 and the connector set 100, the male connector 50 can be manufactured with ease. Specifically, the insulative member is formed by injecting a resin into a plastic injection mold. Accordingly, when manufacturing the insulative member 56, it is necessary to enclose the periphery of the space in which the insulative member 56 is manufactured with the plastic injection mold. However, the insulative member 56 is formed integrally with the anchoring terminal 52. As such, the anchoring terminal 52 acts as an obstacle and makes it difficult to position the plastic injection mold.

Accordingly, as illustrated in FIGS. 11A and 11B, the insulative member 56 is enclosed within the main body portion 61 when viewed from above. In addition, the insulative member holds the anchoring terminal 52 only via the projection portions 64*a* and 64*b*. As a result, a gap is provided between the main body portion 61 and the insulative member 56 when viewed from above. Accordingly, with the male connector 50, the plastic injection mold can be disposed in the gap. As a result, the male connector 50 can be manufactured with ease. Meanwhile, in the case where the insulative member 56 is formed integrally with the anchoring terminal 52, the insulative member 56 and the anchoring terminal 52 can be positioned more precisely than in the case where the anchoring terminal 52 is attached to the insulative member 56 by clamping. Note that the female connector 10 can be manufactured with ease for the same reasons.

In addition, according to the male connector 50 and the connector set 100, it is easy to set the characteristic impedance of the connection terminals 54*a*-54*c* to a predetermined characteristic impedance (50Ω, for example). More specifically, as illustrated in FIGS. 11A and 11B, the insulative member 56 is enclosed within the main body portion 61 when viewed from above. In addition, the insulative member holds the anchoring terminal 52 only via the projection portions 64*a* and 64*b*. Through this, a gap is provided between the main body portion 61 and the insulative member 56 when viewed from above. As a result, a gap is present between the connection terminals 54*a*-54*c* and the anchoring terminal 52, which is filled with air having a low permittivity. Accordingly, a capacity formed between the anchoring terminal 52 and the connection terminals 54*a*-54*c* is suppressed from increasing, and characteristic impedance of the connection terminals 54*a*-54*c* is suppressed from dropping. As such, according to the male connector 50 and the connector set 100, it is easy to set the characteristic impedance of the connection terminals 54*a*-54*c* to a predetermined characteristic impedance (50Ω, for example). For the same reasons, it is easy to set the characteristic impedance of the connection terminals 14*a*-14*c* to a predetermined characteristic impedance (50Ω, for example) in the female connector 10 as well.

In addition, according to the male connector 50 and the connector set 100, the anchoring terminal 52 and the connection terminals 54*a*-54*c* can be given a coplanar structure. Specifically, the anchoring terminal 52 and the connection terminal 54*b* are connected to a ground potential. On the other hand, the connection terminals 54*a* and 54*c* are connected to a signal potential. Through this, the anchoring terminal 52 is located to the left of the connection terminal 54*a* and the connection terminal 54*b* is located to the right of the connection terminal 54*a*, when viewed from above. As such, the anchoring terminal 52 and the connection terminals 54*a* and 54*b* have a coplanar structure. Likewise, the anchoring terminal 52 is located to the right of the connection terminal 54*c* and the connection terminal 54*b* is located to the left of the connection terminal 54*c*, when viewed from above. As such, the anchoring terminal 52 and the connection terminals 54*b* and 54*c* have a coplanar structure. By giving the anchoring terminal 52 and the connection terminals 54*a*-54*c* a coplanar structure, it is easy to set the characteristic impedance of the connection terminals 54*a* and 54*c* to a predetermined characteristic impedance. In addition, noise is suppressed from entering the connection terminals 54*a* and 54*c* from the left-right direction and noise is suppressed from radiating from the connection terminals 54*a* and 54*c* in the left-right direction. Note that for the same reasons, it is easy to set the characteristic impedance of the connection terminals 14*a* and 14*c* to a predetermined characteristic impedance in the female connector 10 as well. In addition, noise is suppressed from entering the connection terminals 14*a* and 14*c* from the left-right direction and noise is suppressed from radiating from the connection terminals 14*a* and 14*c* in the left-right direction.

In addition, according to the male connector 50 and the connector set 100, it is easy to bring the characteristic impedance of the connection terminals 54*a* and 54*c* close to uniform across the entirety thereof. Specifically, as illustrated in FIG. 11B, the minimum distance D11 between the upper portion 60 and the connection terminal 54*a* and the minimum distance D12 between the projection portion 64*a* and the connection terminal 54*a* are substantially equal, when viewed from above. Furthermore, the distance D13 between the connection terminal 54*a* and the connection terminal 54*b* is substantially equal to the minimum distances D11 and D12. Accordingly, the stray capacitance per unit of length produced on the connection terminal 54*a* can be brought close to uniform across the entirety thereof. As such, the characteristic impedance of the connection terminal 54*a* can be brought close to uniform across the entirety thereof. For the same reasons, the characteristic impedance of the connection terminal 54*c* can be brought close to uniform across the entirety thereof. Furthermore, for the same reasons, the characteristic impedance of the connection terminals 14*a* and 14*c* can be brought close to uniform across the entireties thereof.

In addition, in the male connector 50, the connection terminals 54*a*-54*c* are drawn out to the exterior of the ring, when viewed from above. As a result, it is easy to bring a terminal into contact with the connection terminals 54*a*-54*c* and carry out inspections. Furthermore, the connection terminals 54*a*-54*c* can easily be soldered to the land electrodes on the circuit board. For the same reasons, it is easy to bring a terminal into contact with the connection terminals 14*a*-14*c* and carry out inspections with the female connector 10 as well. Furthermore, the connection terminals 14*a*-14*c* can easily be soldered to the land electrodes on the circuit board.

In addition, according to the connector set 100, signal interference is suppressed. Specifically, in the board-to-board connector disclosed in Japanese Unexamined Patent Application Publication No. 2012-79684, the first terminal and the second terminal take on a substantially U shape when connected to each other, and thus overlap in the up-down direction. Accordingly, there is a risk that signal interference will occur due to a capacitance component or an induction component produced between the first terminal and the second terminal that have approached each other.

On the other hand, according to the connector set 100, the connection terminals 14*a*-14*c* extend toward the front from the contact portions 32*a*-32*c* when viewed from above. In addition, the connection terminals 54*a*-54*c* extend toward the rear from the contact portions 72*a*-72*c*, respectively, when viewed from above. The contact portions 32*a*-32*c* are connected to the connection terminals 54*a*-54*c*, respectively. As a result, the connection terminal 14*a* and the connection terminal 54*a* extend in a straight line in the front-rear direction, the connection terminal 14*b* and the connection terminal 54*b* extend in a straight line in the front-rear direction, and the connection terminal 14*c* and the connection terminal 54*c* extend in a straight line in the front-rear direction. Accordingly, the connection terminals 14*a*-14*c* are suppressed from overlapping with the connection terminals 54*a*-54*c*, respectively, in the up-down direction. As a result, according to the connector set 100, signal interference is suppressed.

In addition, according to the connector set 100, it is easy to improve the noise-resistance properties. Specifically, in the board-to-board connector disclosed in Japanese Unexamined Patent Application Publication No. 2012-79684, the first terminal and the second terminal take on a substantially U shape when connected to each other. In other words, the first terminal and the second terminal are disposed in two steps in the up-down direction. Accordingly, it is difficult to secure a space for disposing a conductor for shielding in the vicinity of one of the longer sides of the first housing. As a result, it is difficult to enclose the periphery of the first terminal and the second terminal with a conductor for shielding.

On the other hand, according to the connector set 100, the connection terminal 14*a* and the connection terminal 54*a* extend in a straight line in the front-rear direction, the connection terminal 14*b* and the connection terminal 54*b* extend in a straight line in the front-rear direction, and the connection terminal 14*c* and the connection terminal 54*c* extend in a straight line in the front-rear direction. As such, the connection terminals 14*a*-14*c* and the connection terminals 54*a*-54*c* are not disposed in two steps in the up-down direction. Accordingly, the anchoring terminal 52 can be disposed above the connection terminals 14*a*-14*c* and the anchoring terminal 12 can be disposed below the connection terminals 54*a*-54*c*. In other words, the contact portions 32*a*-32*c* and 72*a*-72*c* can be enclosed with the anchoring terminals 12 and 52, when viewed from above. As a result, according to the connector set 100, it is easy to improve the noise-resistance properties. In addition, according to the connector set 100, noise can be suppressed from radiating to the exterior.

In addition, according to the connector set 100, the connection terminals 14*a*-14*c* and the connection terminals 54*a*-54*c* are arranged in a single row, and thus the size of the connector set 100 can be reduced. Furthermore, because the connection terminals 14*a*-14*c* and the connection terminals 54*a*-54*c* are arranged in a single row, the influence of pitch skew is reduced, which suppresses changes in coupling force, fluctuations in engagement force, and so on between the female connector 10 and the male connector 50.

In addition, according to the connector set 100, the anchoring terminals 12 and 52 contribute greatly to the coupling of the female connector 10 and the male connector 50, whereas the connection terminals 14*a*-14*c* and 54*a*-54*c* contribute almost nothing at all. Accordingly, the strength of the coupling between the female connector 10 and the male connector 50 does not fluctuate greatly even if the number of the connection terminals 14*a*-14*c* and 54*a*-54*c* is changed.

In addition, according to the connector set 100, the insulative members 16 and 56 are suppressed from being subjected to wear when the female connector 10 and the male connector 50 are coupled. Specifically, in the case where the male connector 50 is lowered from a position skewed in the front-rear and left-right directions relative to the female connector 10, the female connector 10 and the male connector 50 are positioned in the front-rear and left-right directions due to the anchoring terminal 12 and the anchoring terminal 52 making contact with each other. During the positioning, the insulative member 16 does not make contact with the anchoring terminal 52, and the insulative member 56 does not make contact with the anchoring terminal 12. Furthermore, the insulative member 16 and the insulative member 56 do not make contact during the positioning. As a result, the insulative members 16 and 56 are suppressed from being subjected to wear.

Other Embodiments

The connectors and connector set according to the present disclosure are not limited to the female connector 10, the male connector 50, and the connector set 100, and can be changed without departing from the essential scope of the present disclosure. Although the female connector 10 is set as the first connector and the male connector 50 is set as the second connector, the male connector 50 can be set as the first connector and the female connector 10 can be set as the second connector.

The female connector 10 and the male connector 50 can be positioned in the front-rear and left-right directions as long as the anchoring terminal 12 has the upper portions 22*a* and 22*d* and the anchoring terminal 52 has the lower portions 62*a* and 62*d*. In other words, the upper portions 22*b* and 22*c* are not absolutely necessary in the anchoring terminal 12, and the lower portions 62*b* and 62*c* are not absolutely necessary in the anchoring terminal 52. Likewise, the anchoring terminal 12 may have the upper portions 22*b* and 22*c* and the anchoring terminal 52 may have the lower portions 62*b* and 62*c* instead. In this case, the upper portions 22*a* and 22*d* are not absolutely necessary in the anchoring terminal 12, and the lower portions 62*a* and 62*d* are not absolutely necessary in the anchoring terminal 52.

In addition, although the anchoring terminal 12 and the anchoring terminal 52 have a substantially rectangular ring shape when viewed from above, these terminals may have a ring shape aside from substantially rectangular, such as a substantially oval or substantially elliptical shape.

In addition, although a space is provided between the anchoring terminal 12 and the insulative member 16, the space may be filled with a material having a lower relative permittivity than the insulative member 16. Through this, the strength of the female connector 10 can be increased. Likewise, the space between the anchoring terminal 52 and the insulative member 56 may be filled with a material having a lower relative permittivity than the insulative member 56.

In addition, it is sufficient for two or more of the connection terminals 14*a*-14*c* to be provided. Likewise, it is sufficient for two or more of the connection terminals 54*a*-54*c* to be provided.

In addition, the connection terminals 14*a*-14*c* and 54*a*-54*c* may be configured only of signal terminals to which a signal potential is applied.

As described thus far, the present disclosure is useful in connector sets and connectors, and is particularly advantageous in that connection terminals can be suppressed from being damaged when the first connector and the second connector are coupled.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A connector set comprising a first connector and a second connector, the first connector including:

a plurality of first connection terminals, each having a first contact portion; and a first anchoring terminal connected to a ground potential, and the second connector including:

a plurality of second connection terminals, each having a second contact portion; and a second anchoring terminal connected to a ground potential, wherein, when the first connector and the second connector are coupled, the plurality of first connection terminals and the plurality of second connection terminals respectively make contact at the first contact portions and the second contact portions and opposite sides of the first connection terminal contact the second connection terminal;

the plurality of first contact portions and the plurality of second contact portions are, when viewed from a first direction, enclosed in a rectangular ring having a first corner portion located in a plane defined by a second direction and a third direction, orthogonal to the second direction and a second corner portion located on the other side of the connector in both the second direction and the third direction;

an outer peripheral surface of the first anchoring terminal in a first corner portion has, when viewed from the first direction, a first surface that faces the second direction and a second surface that faces the third direction, and, in the second corner portion, a third surface that faces opposite to the second direction and a fourth surface that faces opposite to the third direction;

an inner peripheral surface of the second anchoring terminal in the second corner portion has, when viewed from the first direction, a fifth surface that faces opposite to the second direction and, in the second corner portion, a sixth surface that faces opposite to the third direction, and a seventh surface that faces the second direction and an eighth surface that faces the third direction; and the first surface to the fourth surface make contact with the fifth surface to the eighth surface, respectively, when the first connector and the second connector are coupled.

2. The connector set according to claim 1, wherein the first surface and the second surface configure form a convex curved surface at an end portion of the first anchoring terminal when viewed from a direction opposite to the first direction;

the third surface and the fourth surface configure a convex curved surface at the end portion of the first anchoring terminal when viewed from a direction opposite to the first direction;

the fifth surface and the sixth surface configure a convex curved surface at an end portion of the second anchoring terminal when viewed from a direction opposite to the first direction; and the seventh surface and the eighth surface configure a convex curved surface at the end portion of the second anchoring terminal when viewed from a direction opposite to the first direction.

3. The connector set according to claim 2, wherein a first recessed portion and a second recessed portion are provided in the outer peripheral surface of the first anchoring terminal, at the first corner portion and the second corner portion, respectively;

a first protruding portion and a second protruding portion are provided in the inner peripheral surface of the second anchoring terminal, at the first corner portion and the second corner portion, respectively; and the first protruding portion engages with the first recessed portion and the second protruding portion engages with the second recessed portion.

4. The connector set according to claim 1, wherein the first anchoring terminal and the second anchoring terminal make contact with each other to maintain the coupling between the first connector and the second connector, and have, when viewed from the first direction, the rectangular ring shape when the first connector and the second connector are coupled.

5. The connector set according to claim 4, wherein when viewed from the first direction, each of the first connection terminals extends in the second direction from each of the corresponding first contact portions; and when viewed from the first direction, each of the second connection terminals extends in a direction opposite to the second direction from each of the corresponding second contact portions.

6. The connector set according to claim 5, wherein, when viewed from the first direction, the plurality of first contact portions and the plurality of second contact portions are arranged in a single row in the third direction.

7. The connector set according to claim 6, wherein, of the plurality of first connection terminals and the plurality of second connection terminals, signal terminals to which a signal is supplied and ground terminals connected to a ground potential are disposed in an alternating manner.

8. The connector set according to claim 7, wherein, of the plurality of first connection terminals, two first connection terminals located on both ends of the connector in the third direction are the signal terminals.

9. The connector set according to claim 5, wherein, when viewed from the first direction, the first anchoring terminal has a structure in which a first portion of the ring, located in the second direction relative to the plurality of first contact portions, is cut out.

10. The connector set according to claim 9, wherein when viewed from the first direction, the first connection terminals are drawn out to an outer side portion of the ring via the first portion.

11. The connector set according to claim 4, wherein the first connector further includes:

a first insulative member that holds the first connection terminals and the first anchoring terminal, the first anchoring terminal has:

a first main body portion having a structure in which the first portion of the ring is cut out; and a first projection portion that projects from the first main body portion toward the inner side portion of the ring, and a gap is provided between the first main body portion and the first insulative member when viewed from the first direction by the first insulative member holding the first anchoring terminal only by the first projection portion.

12. A first connector that couples with a second connector including a plurality of second connection terminals and a second anchoring terminal, the first connector comprising:

a plurality of first connection terminals; and a first anchoring terminal connected to a ground potential, wherein, when the first connector and the second connector are coupled, the plurality of first connection terminals make contact with the respective second connection terminals at first contact portions and opposite sides of the first connection terminal contact the second connection terminal;

the first contact portions of the plurality of first connection terminals are, when viewed from a first direction, enclosed in a rectangular ring having a first corner portion located in a plane defined by a second direction and a third direction, orthogonal to the second direction, and a second corner portion located on the other side of the connector in both the second direction and the third direction;

an outer peripheral surface of the first anchoring terminal in the first corner portion has, when viewed from the first direction, a first surface that faces the second direction and a second surface that faces the third direction, and, in the second corner portion, a third surface that faces a direction opposite to the second direction and a fourth surface that faces a direction opposite to the third direction; and the first surface to the fourth surface make contact with the second anchoring terminal when the first connector and the second connector are coupled.

13. A connector set comprising a first connector and a second connector, the first connector including:

a plurality of first connection terminals, each having a first contact portion; and a first anchoring terminal connected to a ground potential, and the second connector including:

a plurality of second connection terminals, each having a second contact portion; and a second anchoring terminal connected to a ground potential, wherein, when the first connector and the second connector coupled by inserting the first connection terminals to elastically deform opposite sides of the second connection terminals, the plurality of first connection terminals and the plurality of second connection terminals respectively make contact at the first contact portions and the second contact portions;

the plurality of first contact portions and the plurality of second contact portions are, when viewed from a first direction, enclosed in a rectangular ring having a first corner portion located in a plane defined by a second direction and a third direction, orthogonal to the second direction, and a second corner portion located on the other side of the connector in both the second direction and the third direction;

an outer peripheral surface of the first anchoring terminal in a first corner portion has, when viewed from the first direction, a first surface that faces the second direction and a second surface that faces the third direction, and, in the second corner portion, a third surface that faces opposite to the second direction and a fourth surface that faces opposite to the third direction;

an inner peripheral surface of the second anchoring terminal in the second corner portion has, when viewed from the first direction, a fifth surface that faces opposite to the second direction and, in the second corner portion, a sixth surface that faces opposite to the third direction, and a seventh surface that faces the second direction and an eighth surface that faces the third direction; and the first surface to the fourth surface make contact with the fifth surface to the eighth surface, respectively, when the first connector and the second connector are coupled.

* * * * *